US005871149A

United States Patent [19]

Moroi et al.

[11] Patent Number: 5,871,149

[45] Date of Patent: Feb. 16, 1999

[54] VISCOUS FLUID TYPE HEAT GENERATOR

[75] Inventors: Takahiro Moroi; Takashi Ban; Fumihiko Kitani; Tsutomu Sato, all of Kariya, Japan

[73] Assignee: Kabushiki Kaisha Toyoda Jidoshokki Seisakusho, Kariya, Japan

[21] Appl. No.: 977,323

[22] Filed: Nov. 24, 1997

[30] Foreign Application Priority Data

Nov. 26, 1996 [JP] Japan ..... 8-315261

[51] Int. Cl.[6] ..... B60H 1/02

[52] U.S. Cl. ..... 237/12.3 R; 122/26; 126/247

[58] Field of Search ..... 237/12.3 R, 12.3 B; 122/26; 126/247

[56] References Cited

U.S. PATENT DOCUMENTS 4,974,778 12/1990 Bertling .
5,573,184 11/1996 Martin .

FOREIGN PATENT DOCUMENTS 398107 10/1991 Japan .
9123747 5/1997 Japan .

*Primary Examiner*—Henry A. Bennett
*Assistant Examiner*—Derek S. Boles
*Attorney, Agent, or Firm*—Burgess, Ryan & Wayne

[57] ABSTRACT

A viscous fluid type heat generator including a housing assembly defining a heat generating chamber, a fluid storing chamber communicated through fluid passageway means with the heat generating chamber, and a heat receiving chamber for permitting a heat exchanging fluid to circulate therethrough to receive heat from the heat generating chamber. A rotor element is mounted on a drive shaft for rotation in the heat generating chamber with a gap defined between the inner wall surfaces of the heat generating chamber and the outer faces of the rotor element. The fluid passageway means includes a fluid withdrawing passageway for withdrawing the viscous fluid from the gap into the fluid storing chamber and a fluid supply passageway for supplying the viscous fluid from the fluid storing chamber into the gap. The fluid withdrawing passageway has a separate duct configuration and opens at one end to an outer peripheral region of the heat generating chamber to communicate the outer peripheral region with the fluid storing chamber. The fluid supply passageway has a separate duct configuration and opens at one end to a radially inner region of the heat generating chamber to communicate the radially inner region with the fluid storing chamber.

12 Claims, 6 Drawing Sheets

VISCOUS FLUID TYPE HEAT GENERATOR

BACKGROUND OF THE INVENTION

1. Field of the Invention

The present invention relates to a viscous fluid type heat generator in which a viscous fluid is subjected to a shearing stress in a heat generating chamber to generate heat that is in turn transmitted to a heat-transfer or heat-exchange fluid circulating in a heat receiving chamber to be carried by the heat-transfer fluid to an area to be heated. More particularly, the present invention relates to a viscous-fluid type heat generator which includes an additional chamber communicated with the heat generating chamber for accommodating a viscous fluid, the amount of which is larger than the capacity of a fluid holding gap defined in the heat generating chamber. The present invention may be embodied, for example, as a supplementary heat source incorporated in a vehicle heating system for comfortably heating the passenger compartment of a vehicle.

2. Description of the Related Art

Japanese Unexamined Utility Model Publication (Kokai) No. 3-98107 (JP-U-3-98107) discloses a conventional viscous fluid type heat generator incorporated in a vehicle heating system, which includes means for adjusting the heat generating performance of the heat generator. The viscous fluid type heat generator disclosed in JP-U-3-98107 includes a housing having mutually opposing front and rear portions which define an inner heat generating chamber and a heat receiving chamber arranged to surround the heat generating chamber. The heat generating chamber is separated from the heat receiving chamber by a partition wall through which heat is exchanged between a viscous fluid in the heat generating chamber and a heat-exchange fluid in the heat receiving chamber. The heat-exchange fluid is introduced into the heat receiving chamber from an external heating system, and is delivered from the heat receiving chamber to the heating system, so as to be constantly circulated through the heat generator and the heating system.

A drive shaft is rotatably supported in the front and rear portions of the housing by bearings, and a rotor element is fixedly mounted on the shaft to rotate inside the heat generating chamber together with the shaft. The rotor element includes outer faces arranged in a face-to-face relationship with the inner wall surfaces of the heat generating chamber to define therebetween small gaps in the shape of axial labyrinth channels. The viscous fluid, generally a polymeric material such as silicone oil which has a high viscosity, is supplied into the heat generating chamber to fill the small gaps between the outer faces of the rotor element and the inner wall surfaces of the heat generating chamber.

The viscous fluid type heat generator of JP-U-3-98107 also includes a viscous fluid reservoir, the casing of which is fixedly attached to the bottom of the generator housing. A diaphragm is supported on the upper inner wall of the reservoir to define therein an additional chamber which is in fluidic communication with the heat generating chamber to permit the viscous fluid to flow freely from one chamber to the other. The heat generating chamber communicates with the environmental atmosphere through a hole penetrating the top wall of the generator housing, thereby allowing the free flow of the viscous fluid. The diaphragm is selectively shifted between uppermost and lowermost positions by the interaction of a manifold negative pressure and a spring force, both applied onto the back side the diaphragm, to adjust the capacity of the additional chamber.

When the drive shaft of the above viscous fluid type heat generator, incorporated in the vehicle heating system, is driven by a vehicle engine, the rotor element is also rotated within the heat generating chamber. At this time, if the diaphragm is located at the uppermost position and thus the viscous fluid entirely fills the heat generating chamber, the rotating rotor element provides a shearing stress to the viscous fluid held between the inner wall surfaces of the heat generating chamber and the outer faces of the rotor element. The viscous fluid then generates heat due to the shearing stress applied thereto. The generated heat is transmitted from the viscous fluid to the heat-exchange fluid circulating through the heat receiving chamber, and the heat-exchange fluid carries the transmitted heat to the heating circuit of the vehicle heating system.

In the viscous fluid type heat generator of JP-U-3-98107, if too much heat is generated by the generator and should be reduced or stopped, the diaphragm is shifted toward the lowermost position by applying the manifold negative pressure onto the back side of the diaphragm, whereby transferring the viscous fluid from the heat generating chamber into the additional chamber of the reservoir. Consequently, the heat generation due to the shearing stress applied to the viscous fluid is reduced or stopped, and the heating capacity of the vehicle heating system is reduced. On the contrary, if the heat generation of the generator is too little and should be increased, the diaphragm is shifted toward the uppermost position by applying the spring force onto the back side of the diaphragm, whereby transferring the viscous fluid from the additional chamber of the reservoir into the heat generating chamber. Consequently, the heat generation due to the shearing stress applied to the viscous fluid is increased, and the heating capacity of the vehicle heating system is increased.

In the above viscous fluid type heat generator, however, when the viscous fluid is transferred from the heat generating chamber into the additional chamber, fresh environmental air is introduced into the heat generating chamber through the top hole of the housing to compensate for the negative pressure in the heat generating chamber due to the removal of the viscous fluid. Therefore, the viscous fluid comes into contact with the introduced fresh air whenever the viscous fluid is transferred into the additional chamber, i.e., whenever the heat generation is to be decreased. This causes problems in that the oxidation and degradation of the viscous fluid is accelerated, and that the viscosity of the viscous fluid is affected or decreased due to the addition of water from the atmosphere.

The above problems caused due to the fresh air introduced into the heat generating chamber can be eliminated by forming the heat generating chamber as a fluid-tight chamber. Viscous fluid type heat generators including such a fluid-tight heat generating chamber are well known in the art, and one example is disclosed in the specification of Japanese Patent Application No. 7-217035 that is a co-pending application by the applicant of the present case. The fluid-tight heat generating chamber does not allow the environmental fresh air to enter therein, and can thus prevent the viscous fluid held therein from coming into contact with the fresh air. Therefore, oxidation and degradation of the viscous fluid is prevented, and the addition of water, from the atmosphere, to the viscous fluid is avoided.

In this type of heat generator including the fluid-tight heat generating chamber, when a rotor element is rotating in the heat generating chamber, the viscous fluid such as silicone oil tends to be collected in the radially inner or center region of the heat generating chamber, by the Weissenberg effect as a normal stress effect caused due to the rotation of the rotor element positioned perpendicularly to the fluid level surface of the viscous fluid. At the same time, the viscous fluid in the heat generating chamber is subjected to the centrifugal force acting radially outwardly from the center region.

In this respect, it has been found that, when the rotor element rotates at a speed lower than a predetermined rotation speed, the Weissenberg effect is much stronger than the centrifugal force, and thus the viscous fluid circulates in the heat generating chamber substantially under the Weissenberg effect. As the speed of the rotor element increases from such a lower speed, the effect of the centrifugal force is increased and the Weissenberg effect is reduced, and thus the viscous fluid circulates in the heat generating chamber under both the centrifugal force and the Weissenberg effect. Then, when the speed of the rotor element exceeds a predetermined high rotation speed, the centrifugal force becomes much stronger than the Weissenberg effect, and thus the viscous fluid circulates in the heat generating chamber substantially under the centrifugal force.

However, the viscous fluid type heat generator including a fluid-tight heat generating chamber has a problem that the viscous fluid is held in very small gaps between the inner wall surfaces of the heat generating chamber and the outer faces of the rotor element to ensure the sufficient heat generation, and thus the viscous fluid is difficult to smoothly circulate in the small gaps. Consequently, the temperature of the viscous fluid in the fluid-tight heat generating chamber, especially in the radially outer regions of the small gaps where the viscous fluid is subjected to the higher circumferential speed of the rotor, rises to a significant level, and the viscous fluid is degraded when the temperature exceeds the limit of the heat resisting properties of the viscous fluid. Therefore, it is difficult, in this type of heat generator, to maintain good, stable and efficient heat generation for a long period.

SUMMARY OF THE INVENTION

Therefore, an object of the present invention is to provide a viscous fluid type heat generator which eliminates the problems of the degradation of the viscous fluid in the conventional heat generator including an open-type heat generating chamber, and which facilitates the smooth circulation of the viscous fluid held in the small gaps, defined to ensure the sufficient heat generation, between the inner wall surfaces of the heat generating chamber and the outer faces of the rotor element, so as to prevent the degradation of the viscous fluid due to an extremely high temperature rise thereof.

In accordance with the present invention, there is provided a viscous fluid type heat generator comprising: a housing assembly defining therein a heat generating chamber in which heat is generated, a fluid storing chamber communicated through fluid passageway means with the heat generating chamber, and a heat receiving chamber arranged separately from the heat generating and fluid storing chambers for permitting a heat exchanging fluid to circulate through the heat receiving chamber to thereby receive heat from the heat generating chamber, the heat generating chamber having inner wall surfaces thereof, in which the fluid passageway means opens, and forming a fluid-tight chamber together with the fluid storing chamber; a drive shaft supported by the housing assembly to be rotatable about an axis of rotation of the drive shaft, the drive shaft being operationally connected to an external rotation-drive source; a rotor element mounted to be rotationally driven by the drive shaft for rotation together with the drive shaft within the heat generating chamber, the rotor element having outer faces confronting the inner wall surfaces of the heat generating chamber via a predetermined gap defined therebetween; and a viscous fluid, held in the gap defined between the inner wall surfaces of the heat generating chamber and the outer faces of the rotor element, for heat generation by the rotation of the rotor element, and stored in the fluid storing chamber of the housing assembly, the viscous fluid being able to flow between the heat generating chamber and the fluid storing chamber through the fluid passageway means; wherein the fluid passageway means comprises a fluid withdrawing passageway for withdrawing the viscous fluid from the gap in the heat generating chamber into the fluid storing chamber and a fluid supply passageway for supplying the viscous fluid from the fluid storing chamber into the gap in the heat generating chamber; the fluid withdrawing passageway having a separate duct configuration and opening at one end to an outer peripheral region of the heat generating chamber to communicate the outer peripheral region of the heat generating chamber with the fluid storing chamber; and the fluid supply passageway having a separate duct configuration and opening at one end to a radially inner region of the heat generating chamber to communicate the radially inner region of the heat generating chamber with the fluid storing chamber.

In this viscous fluid type heat generator, it is preferred that the fluid withdrawing passageway opens to the fluid storing chamber at a position above a fluid level of the viscous fluid accommodated in the fluid storing chamber, and wherein the fluid supply passageway opens to the fluid storing chamber at a position below the fluid level of the viscous fluid accommodated in the fluid storing chamber.

Also, it is advantageous that the fluid passageway means further includes a second fluid withdrawing passageway opening to a radially inner region of the heat generating chamber, the second fluid withdrawing passageway being formed separately from first the fluid withdrawing passageway and the fluid supply passageway, to communicate the radially inner region of the heat generating chamber with the fluid storing chamber.

In this arrangement, the first and second fluid withdrawing passageways may open to the fluid storing chamber at positions above a fluid level of the viscous fluid accommodated in the fluid storing chamber, and the fluid supply passageway may open to the fluid storing chamber at a position below the fluid level of the viscous fluid accommodated in the fluid storing chamber.

Preferably, the heat generating chamber defines, in the outer peripheral region thereof, an annular communication gap portion between a circumferential wall surface of the heat generating chamber and a circumferential face of the rotor element to join opposed gap portions disposed at front and rear sides of the rotor element, and wherein the fluid withdrawing passageway opens to and confronts the annular communication gap portion.

The above heat generator of claim 1 may further include a fluid guide, provided in the heat generating chamber, for guiding the viscous fluid held in the gap along the fluid guide from the radially inner region of the heat generating chamber toward the outer peripheral region thereof upon rotation of the rotor element.

In this arrangement, it is preferred that the fluid guide includes at least one channel recessed in at least one of inner wall surfaces of the heat generating chamber to open over substantially an entire length of the channel to the heat generating chamber, the channel extending from the radially inner region of the heat generating chamber toward the outer peripheral region thereof.

It is also preferred that the at least one channel linearly extends along a center line thereof which is angularly shifted from a radial line of the at least one of inner wall surfaces so that a radially inner end of the channel is displaced rearward relative to the radial line in a direction of rotation of the rotor element.

The withdrawing passageway may open at one end to and directly communicate with the channel.

The above heat generator may further include a partition member for separating the heat generating chamber from the fluid storing chamber, the fluid withdrawing passageway being formed in the partition member.

In this arrangement, the partition member may be provided with a division wall for defining a passage of the heat exchanging fluid in the heat receiving chamber, the fluid withdrawing passageway being formed in the division wall.

It is also preferred that the fluid storing chamber is designed to accommodate the viscous fluid, an amount of which is larger than the capacity of the gap defined in the heat generating chamber, and that the fluid storing chamber is formed adjacent to the heat receiving chamber.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENTS

Figure 1:
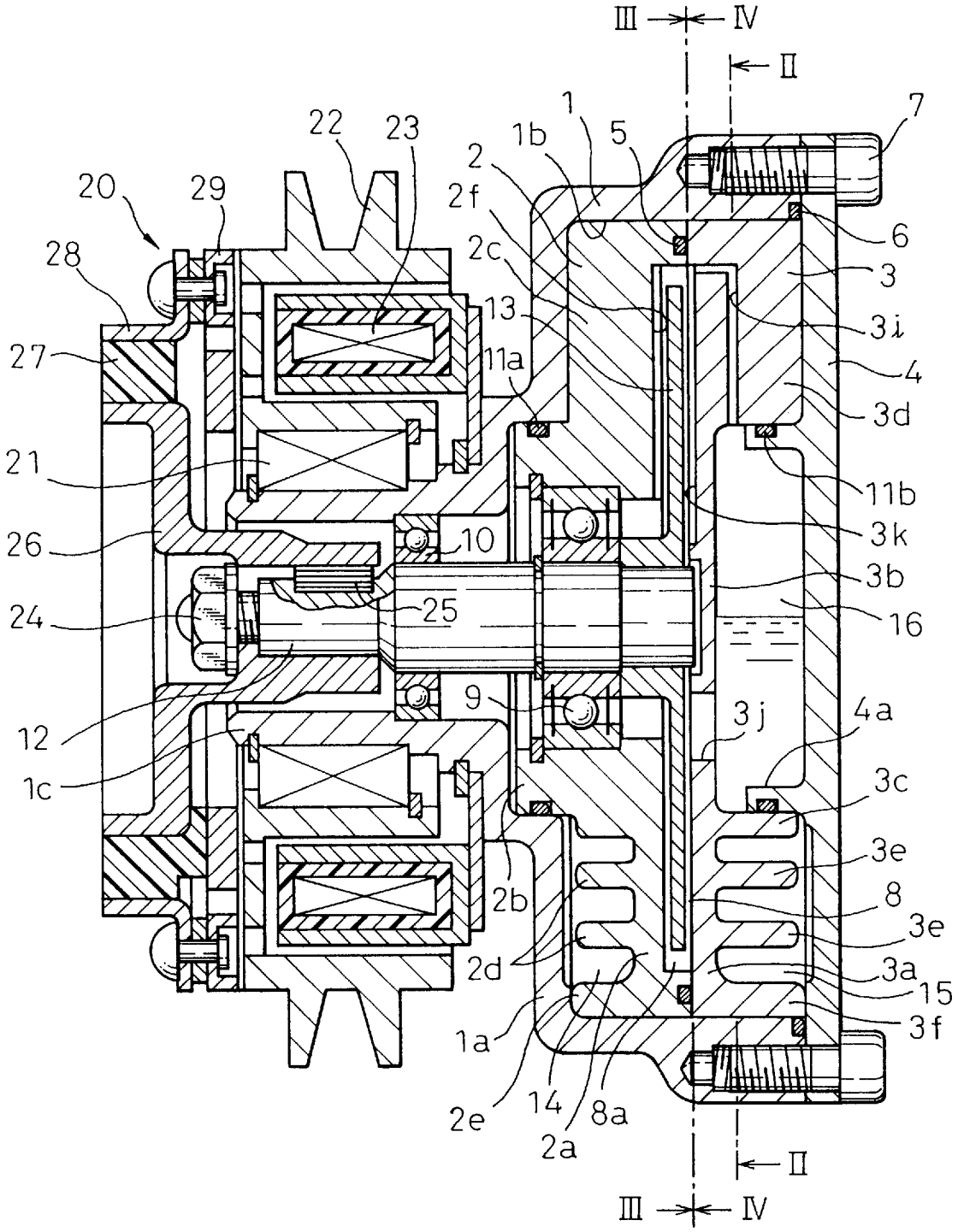
FIG. 1 is a longitudinal sectional view of a first embodiment of a viscous fluid type heat generator according to the present invention.

Referring now to the drawings, wherein the same or similar components are designated by the same reference numerals, FIGS. 1 to 4 show a first embodiment of a viscous fluid type heat generator according to the present invention, which is adapted to be incorporated in a vehicle heating system.

The heat generator of the first embodiment includes a front housing body 1, a front plate member 2, a rear plate member 3 and a rear housing body 4, which are assembled in a following manner to form a housing assembly of the heat generator. The front housing body 1 includes a cup-shaped section la defining therein a cup-shaped recess 1*b*, and a center boss 1*c* coaxially extending frontward from the center region of the cup-shaped section la to define therein a center through bore. The rear housing body 4 is shaped as a generally flat annular plate. The front housing body 1 is closed at a rear opening end of the cup-shaped recess 1*b* thereof by the rear housing body 4 through the interposition of an O-ring 6 hermetically sealing between the cup-shaped section 1*a* and the rear housing body 4, and axially and tightly combined with the rear housing body 4 by a plurality of screw bolts 7 (only two bolts 7 are shown in FIG. 1).

The front and rear plate members 2 and 3, as partition members of the invention, are stacked with each other through the interposition of an O-ring 5 hermetically sealing between the outer peripheral regions of the mutually opposed surfaces of the plate members 2, 3. The mutually stacked plate members 2, 3 are housed and fitted within the cup-shaped recess 1*b* of the front housing body 1, and fixedly supported therein by the mutually secured front and rear housing bodies 1, 4. The front and rear plate members 2, 3 may be made of any materials having a high thermal conductivity.

The front plate member 2 has axially opposed front and rear faces, and includes a radially outer annular part 2*a* and a center cylindrical support part 2*b* coaxially extending frontward from the inner edge region of the annular part 2*a*. The cylindrical support part 2*b* is fitted inside a shoulder formed between the cup-shaped section 1*a* and center boss 1*c* of the front housing body 1. An O-ring 11*a* is arranged to hermetically seal between the support part 2*b* and the front housing body 1.

The rear plate member 3 has axially opposed front and rear faces, and includes a radially outer annular part 3*a* and a center flat part 3*b*. The rear plate member 3 also includes a cylindrical part 3*c*, coaxially extending rearward from the rear face thereof, which defines a boundary between the parts 3*a* and 3*b*. On the other hand, the rear housing body 4 also includes a cylindrical support part 4*a* coaxially extending frontward from the inner wall face thereof. The cylindrical part 3*c* of the rear plate member 3 is fitted outside the cylindrical support part 4*a* of the rear housing body 4. An O-ring 11*b* is arranged to hermetically seal between the cylindrical part 3*c* and the support part 4*a*.

The flat rear face of the front plate member 2 is provided with an annular recess formed therein. A flat annular bottom face and a cylindrical circumferential face of the annular recess formed in the front plate member 2 cooperate with the flat front face of the rear plate member 3 to define a heat generating chamber 8 therebetween. The bottom and circumferential faces of the annular recess of the front plate member 2 as well as the front face of the rear plate member 3 constitute inner wall surfaces of the heat generating chamber 8.

The front face of the annular part 2*a* of the front plate member 2 is also provided with a division wall 2*c* axially projecting frontward from the front face and radially outwardly extending from the cylindrical support part 2*b*, two C-shaped ridges 2*d* axially projecting frontward from the front face and concentrically extending around the cylindrical support part 2*b*, the opposed edges of each ridge 2*d* being separated from the division wall 2*c*, and an outermost annular ridge 2*e* axially projecting frontward from the outer edge of the annular part 2*a* and concentrically extending around the C-shaped ridges 2*d*.

The inner wall face of the cup-shaped recess 1*b* of the front housing body 1 cooperates with the front face of the annular part 2*a* of the front plate member 2, involving the faces of support part 2*b*, division wall 2*c*, C-shaped ridges 2*d* and annular ridge 2*e*, to define a C-shaped front heat receiving chamber 14 arranged near the front side of the heat generating chamber 8. The front edges of the division wall 2*c* and annular ridge 2*e* are in contact with the inner wall face of the front housing body 1. The front heat receiving chamber 14 is separated in a fluid-tight manner from the heat generating chamber 8 by the front plate member 2 interposed therebetween.

Figure 2:
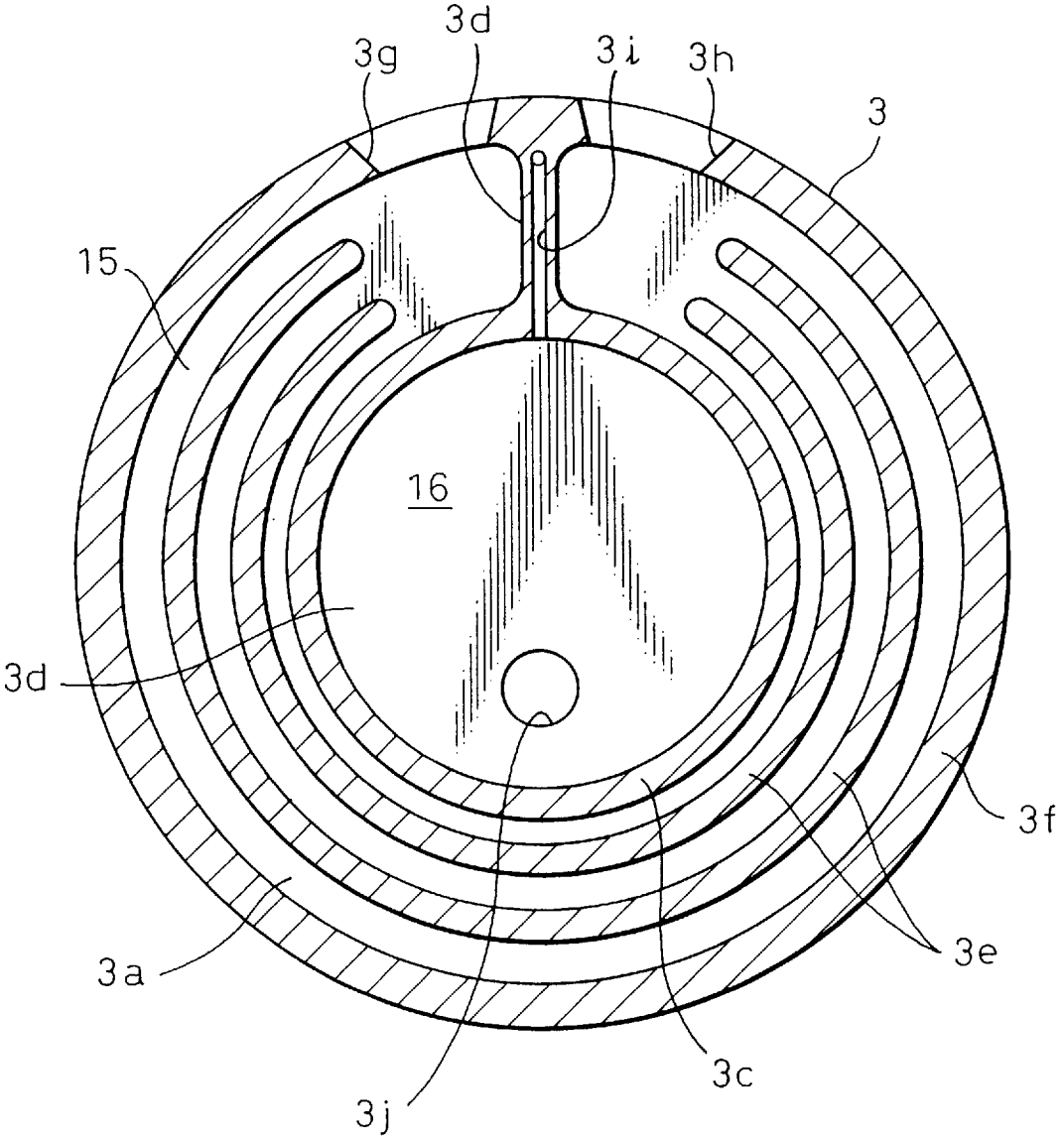
FIG. 2 is a sectional view of a rear plate member of the heat generator, taken along a line II—II of FIG. 1.

As best seen in FIG. 2, the rear face of the annular part 3*a* of the rear plate member 3 is provided with a division wall 3*d* axially rearwardly projecting from the rear face and radially outwardly extending from the cylindrical part 3*c*, two C-shaped ridges 3*e* axially rearwardly projecting from the rear face and concentrically extending around the cylindrical part 3*c*, the opposed edges of each ridge 3*e* being separated from the division wall 3*d*, and an outermost annular ridge 3*f* axially rearwardly projecting from the outer edge of the annular part 3*a* and concentrically extending around the C-shaped ridges 3*e*.

The inner wall face of the rear housing body 4, radially outside the cylindrical support part 4*a*, cooperates with the rear face of the annular part 3*a* of the rear plate member 3, involving the faces of cylindrical part 3*c*, division wall 3*d*, C-shaped ridges 3*e* and annular ridge 3*f*, to define a C-shaped rear heat receiving chamber 15 arranged near the rear side of the heat generating chamber B. The rear edges of the division wall 3*d* and annular ridge 3*f* are in contact with the inner wall face of the rear housing body 4. The rear heat receiving chamber 15 is separated in a fluid-tight manner from the heat generating chamber 8 by the rear plate member 3 interposed therebetween.

Inlet and outlet ports (not shown) are formed in the outer circumference of the cup-shaped section 1*a* of the front housing body 1 at respective positions adjacent the opposite sides of both the division walls 2*c*, 3*d* of the front and rear plate members 2, 3. The plate member 2 is provided with openings (not shown) for respectively communicating the inlet and outlet ports with the heat receiving chamber 14. Also, the plate member 3 is provided with openings 3*g* and 3*h* (see FIG. 2) for respectively communicating the inlet and outlet ports with the heat receiving chamber 15.

Heat exchanging fluid circulating through the heating circuit (not shown) of the vehicle heating system is introduced through the inlet port and the openings (only the opening 3*g* is shown) into the heat receiving chambers 14, 15, and is discharged from the heat receiving chambers 14, 15 through the openings (only the opening 3*h* is shown) and the outlet port into the heating circuit. That is, the heat exchanging fluid introduced through the inlet port into the rear heat receiving chamber 15 flows in a counterclockwise direction in FIG. 2, through substantially circular passages defined by the annular ridges 3*e* in the heat receiving chamber 15, and is finally discharged from the heat receiving chamber 15 through the outlet port.

The inner wall face of the rear housing body 4, radially inside the cylindrical support part 4*a*, cooperates with the rear face of the center part 3b of the rear plate member 3 to define a cylindrical fluid storing chamber 16 arranged near the rear side of the heat generating chamber 8. The fluid storing chamber 16 is separated in a fluid-tight manner from the rear heat receiving chamber 15. On the other hand, the fluid storing chamber 16 communicates with the heat generating chamber 8 through two passageways formed in the rear plate member 3 as described later. A predetermined amount of viscous fluid, such as silicone oil, is accommodated within both the heat generating chamber 8 and the fluid storing chamber 16.

A drive shaft 12, typically positioned in a substantially horizontal state, is supported by a bearing 9, mounted inside the cylindrical support part 2*b* of the front plate member 2, and by a bearing 10, mounted inside the center boss 1*c* of the front housing body 1, to be rotatable about a generally horizontal axis of rotation. The rear end portion of the drive shaft 12 is located in the interior space of the cylindrical support part 2*b*, which directly communicates with the heat generating chamber 8. The bearing 9 includes a sealing mechanism, whereby the heat generating chamber 8, as well as the interior space of the cylindrical support part 2*b*, are sealed in a fluid-tight manner from the exterior of the heat generator.

A rotor element 13 in the shape of flat circular disc is mounted and tightly fitted on the rear end portion of the drive shaft 12. The rotor element 13 is arranged within the heat generating chamber 8 in such a manner as to be rotatable, by the drive shaft 12, about the generally horizontal rotation axis thereof. The rotor element 13 has axially opposed flat circular faces and a circumferential face, which form the outer faces of the rotor element 13. The outer faces of the rotor element 13 do not come into contact with the inner wall surfaces of the heat generating chamber B at any time, and thus define therebetween a relatively small gap for holding a viscous fluid as described later.

More specifically, the small gap includes an annular communication gap portion 8*a* defined between the circumferential inner wall surface of the heat generating chamber 8 and the circumferential face of the rotor element 13, a front gap portion defined between the front inner wall surface of the heat generating chamber 8 and the front face of the rotor element 13, and a rear gap portion defined between the rear inner wall surface of the heat generating chamber 8 and the rear face of the rotor element 13. The front and rear gap portions are joined together and communicated with each other by the annular communication gap portion 8*a*. In this embodiment, the annular communication gap portion 8*a* has a larger gap size than the front and rear gap portions to facilitate the intercommunication therethrough of the viscous fluid held in the front and rear gap portions.

The rear plate member 3 is further provided with a fluid withdrawing passageway 3*i* for withdrawing a viscous fluid held in the small gap defined in the heat generating chamber 8 to the fluid storing chamber 16, and a fluid supply passageway 3*j* for supplying a viscous fluid stored in the fluid storing chamber 16 to the heat generating chamber 8. The fluid withdrawing passageway 3*i* and the fluid supply passageway 3*j* are formed separately from each other in the rear plate member 3.

The fluid withdrawing passageway 3*i* has a bent duct configuration, and penetrates through the rear plate member 3 at the division wall (3*d*) portion thereof to extend in the division wall 3*d* between the front face of the rear plate member 3 and the radially inner, top face of the cylindrical part 3*c* thereof. The fluid withdrawing passageway 3*i* opens at one end to the top region of the annular communication gap portion 8*a* defined in the heat generating chamber 8, and at the other end to the top region of the fluid storing chamber 16.

Figure 3:
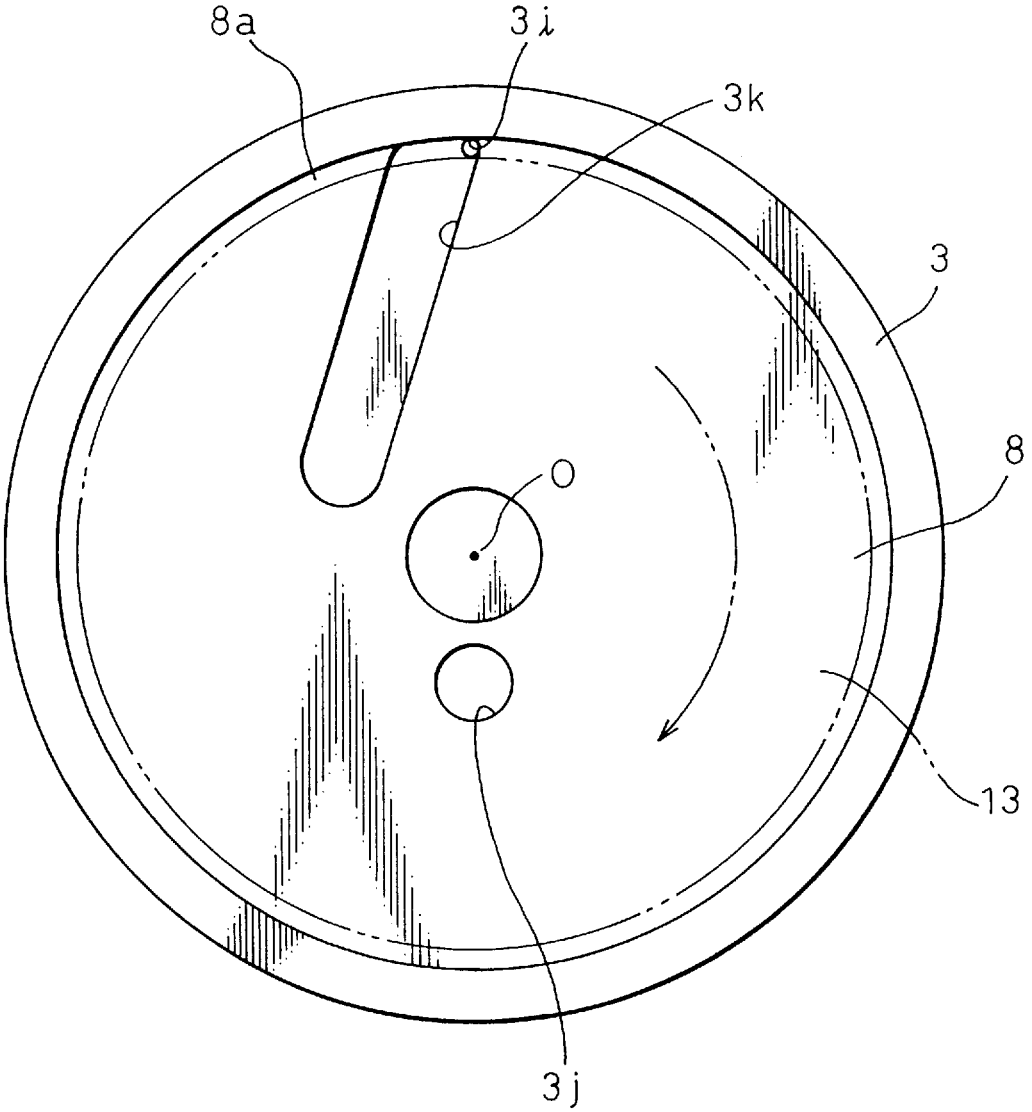
FIG. 3 is a front end view of the rear plate member of the heat generator, taken along a line III—III of FIG. 1.

The fluid withdrawing passageway 3*i* is directly communicated at one open end thereof with a channel 3*k* as a fluid guide formed on the front face of the rear plate member 3. The channel 3*k* opens to the upper region of the rear gap portion defined in the heat generating chamber 8 over substantially the entire channel length, and linearly extends in an angled radial direction at a position above a rotation axis O (see FIG. 3) of the rotor element 13, which coincides with the rotation axis of the drive shaft 12. That is, as shown in FIG. 3, the channel 3*k* has a center line angularly shifted from a radial line of the rear plate member 3 so that the lower or radially inner end of the channel 3*k*, which opens to and confronts the center region of the rear gap portion, is displaced rearward relative to the radial line in the direction of rotation of the rotor element 13 (shown by an arrow). The upper or radially outer end of the channel 3*k* reaches the circumferential inner wall surface of the heat generating chamber 8, i.e., opens to and confronts the top region of the annular communication gap portion 8*a*. The fluid withdrawing passageway 3*i* opens at the upper front edge of the channel 3*k* in the rotation direction of the rotor element 13.

The fluid supply passageway 3*j* has a straight duct configuration, and penetrates through the center part 3*b* of the rear plate member 3 to extend between the front and rear faces of the rear plate member 3. The diameter of the fluid supply passageway 3*j* is larger than that of the fluid withdrawing passageway 3*i*. The fluid supply passageway 3*j* opens at one end to the lower region of the rear gap portion defined in the heat generating chamber 8, and at the other end to the lower region of the fluid storing chamber 16.

Figure 4:
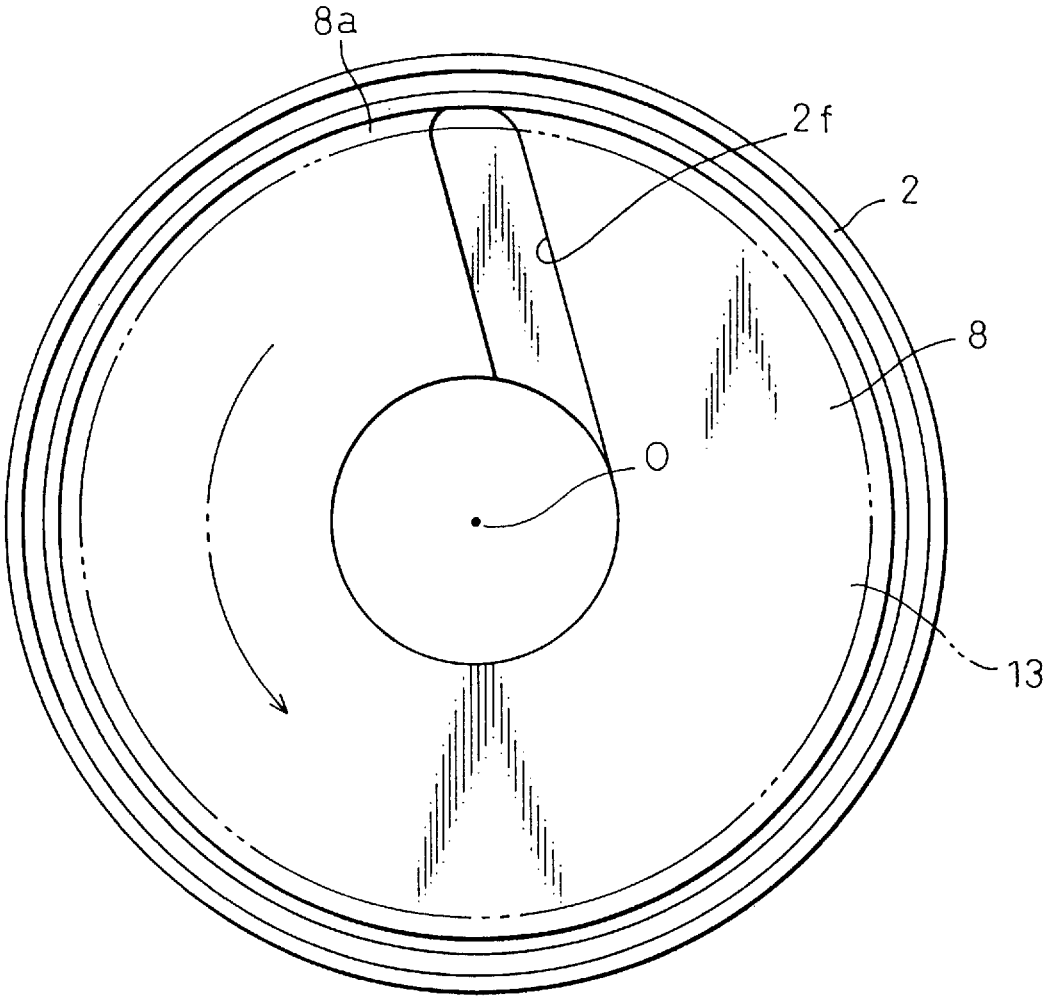
FIG. 4 is a rear end view of a front plate member of the heat generator, taken along a line IV—IV of FIG. 1.

The front plate member 2 is provided with a channel 2*f* formed on the bottom face of the annular recess, i.e., on the front inner wall surface of the heat generating chamber 8. The channel 2*f* opens to the upper region of the front gap portion defined in the heat generating chamber 8 over substantially the entire channel length, and linearly extends in an angled radial direction at a position above the rotation axis O (see FIG. 4) of the rotor element 13. That is, as shown in FIG. 4, the channel 2*f* has a center line angularly shifted from a radial line of the front plate member 2 so that the lower or radially inner end of the channel 2*f*, which opens to and confronts the center region of the rear gap portion, is displaced rearward relative to the radial line in the rotation direction of the rotor element 13 (shown by an arrow). The upper or radially outer end of the channel 2*f* reaches the circumferential inner wall surface of the heat generating chamber 8, i.e., opens to and confronts the top region of the annular communication gap portion 8*a*.

The heat generating chamber 8 and the fluid storing chamber 16 communicated with the heat generating chamber 8 form a fluid-tight chamber for accommodating a viscous fluid. More specifically, the gap defined between the inner wall surfaces of the heat generating chamber 8 and the outer faces of the rotor element 13, as well as the fluid storing chamber 16, are constantly filled with the viscous fluid, such as a silicone oil, and a gaseous material. The amount of the viscous fluid accommodated in the heat generating chamber 8 and the fluid storing chamber 16 is preferably selected so that, when the drive shaft 12 is positioned in a substantially horizontal state and the rotor element 13 does not rotate, the fluid level of the viscous fluid in the fluid storing chamber 16 is maintained at least above the fluid supply passageway 3*j*.

In the viscous fluid type heat generator of the first embodiment, the capacity of the fluid storing chamber 16 is designed to be larger than the capacity of the fluid holding gap defined in the heat generating chamber 8. Therefore, it is possible to select the amount of the viscous fluid supplied to the fluid-tight chamber in a relatively wide range, i.e., in such a manner as to be larger than the capacity of the gap but smaller than the total capacity of the gap plus the fluid storing chamber 16, which eliminates a strict management or a precise determination of the amount of the viscous fluid to be held in the gap.

It should be noted that, in the heat generator of the first embodiment, the residual space defined inside the boss 2*b* of the front plate member 2, adjacent and forward of the heat generating chamber 8, may accommodate a certain amount of the viscous fluid, but it does not contribute to heat generation by the viscous fluid, and therefore it is disregarded in the above and below description to simplify the description.

Referring again to FIG. 1, the drive shaft 12 is connected through an electromagnetic clutch device 20 disposed adjacent the center boss 1*c* of the front housing body 1 to a vehicle engine (not shown) as a rotational drive source. The electromagnetic clutch device 20 includes a pulley 22 supported for rotation by a bearing 21 on the center bore 1*c*, a cylindrical core with a coil 23, which is supported on the front housing body 1 so as to be arranged in an annular recess formed in the rear side of the pulley 22, a hub plate 26 fixed through a bolt 24 and a key 25 to the front end of the drive shaft 12 for rotation together with the drive shaft 12, and an armature 29 axially shiftably supported on the hub plate 26 through an annular rubber 27 and a flange plate 28 for rotation together with the hub plate 26. The operating surface of the armature 29 confronts the front surface of the pulley 22, which forms a counterpart operating surface of the clutch device 20. The pulley 22 is operatively connected by a belt (not shown) to the vehicle engine (not shown). The coil 23 exerts an electromagnetic force through the front surface of the pulley 22 on the armature 29 to attract it toward the pulley 22.

The viscous fluid type heat generator thus constructed is incorporated into the heating circuit of the vehicle heating system. When the engine operates, the output torque of the engine is transmitted through the belt to the pulley 22. When the coil 23 of the electromagnetic clutch device 20 is energized during the time that the pulley 22 is driven for rotation, the armature 29 is attracted and joined to the front surface of the pulley 22, against the frontward biasing force applied by the annular rubber 27, by the electromagnetic force. Thereby the rotation or torque of the pulley 22 is transmitted through the armature 29 and the hub plate 26 to the drive shaft 12.

When the drive shaft 12 is driven by the vehicle engine, the rotor element 13 is rotated within the heat generating chamber 8. Therefore, the viscous fluid such as silicone oil is extended generally in the entire region of the gap defined between the inner wall surfaces of the heat generating chamber 8 and the outer faces of the rotor element 13, and is subjected to a shearing stress by the rotating rotor element 13. Consequently, the viscous fluid generates heat, which is transmitted to the heat exchanging fluid, typically water, flowing through the front and rear heat receiving chambers 14 and 15. Then, the heat is carried by the heat exchanging fluid to the heating circuit of the heating system to heat an objective area of the vehicle, e.g., a passenger compartment.

Figure 5A:
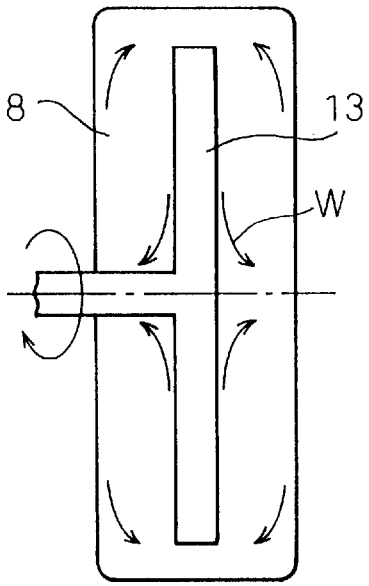
FIGS. 5A to 5D schematically illustrate several circulation modes of a viscous fluid in a heat generating chamber of the heat generator.
Figure 5B:
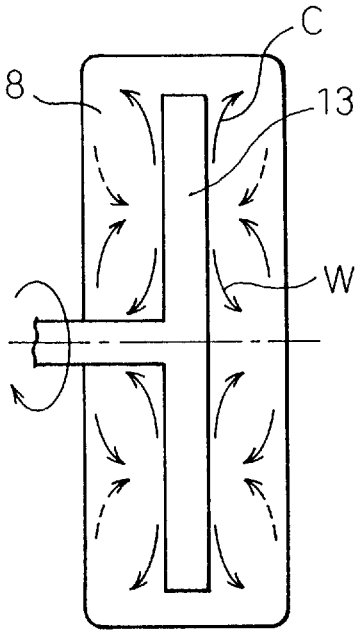
Figure 5C:
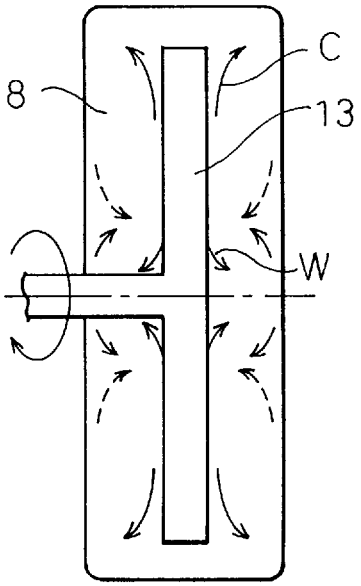
Figure 5D:
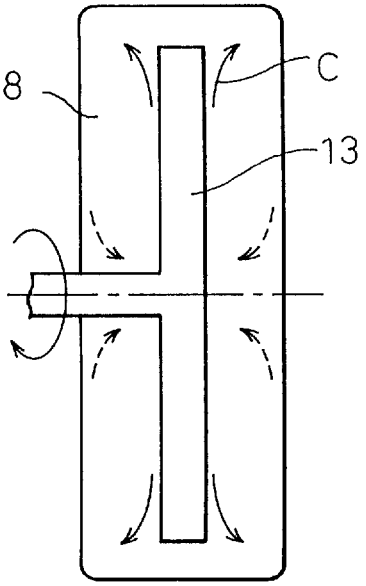

If the gap defined in the heat generating chamber 8 is relatively large, as diagrammatically shown in FIGS. 5A to 5D, when the rotor element 13 rotates at a speed lower than a predetermined rotation speed, the Weissenberg effect W is much stronger than the centrifugal force C, and thus the viscous fluid such as silicone oil tends to be collected in the radially inner region of the heat generating chamber 8, i.e., the generally center region of the flat disc-shaped rotor element 13. Thereby, the viscous fluid circulates in the gap substantially under the Weissenberg effect W (FIG. 5A). As the speed of the rotor element 13 increases from such a lower speed, the effect of the centrifugal force C is gradually increased and the Weissenberg effect W is gradually reduced, and thus the viscous fluid circulates in the gap under both the centrifugal force C and the Weissenberg effect W (FIGS. 5B and 5C). Then, when the speed of the rotor element 13 exceeds a predetermined high rotation speed, the centrifugal force C becomes much stronger than the Weissenberg effect W, and thus the viscous fluid circulates in the gap substantially under the centrifugal force C (FIG. 5D).

In practice, the heat generator of the type of the present invention has a relatively small fluid-holding gap defined in the heat generating chamber to ensure the sufficient heat generation, and thus the viscous fluid is only with difficulty smoothly circulated in the small gaps, which may cause the degradation of the viscous fluid. Therefore, the present invention adopts means for accelerating the circulation of the viscous fluid held in the small gap, which means comprises in the first embodiment the fluid storing chamber 16, the fluid withdrawing passageway 3*i*, the fluid supply passageway 3*j* and the channels 2*f* and 3*k*.

In the heat generator of the first embodiment, when the rotor element 13 rotates in the heat generating chamber 8, the fluid pressure in the radially outer region of the heat generating chamber 8 is larger than that in the radially inner region thereof due to the difference of the circumferential speed between the outer peripheral and center regions of the rotor element 13. Therefore, the viscous fluid in the radially outer region is readily withdrawn through the fluid withdrawing passageway 3*i*, opening to the radially outer, higher-pressure, top region of the heat generating chamber 8, into the fluid storing chamber 16. At the same time, the viscous fluid stored in the fluid storing chamber 16 is readily introduced through the fluid supply passageway 3*j*, opening to the radially inner, lower-pressure region of the heat generating chamber 8, into the heat generating chamber 8.

In this manner, the heat generator of the first embodiment permits the viscous fluid held in the small gap defined in the heat generating chamber 8 to circulate smoothly from the radially outer top region of the gap through the fluid storing chamber 16 to the radially inner region of the gap. That is, this heat generator can establish the automatic replacement of the viscous fluid to be subjected to the shearing stress in the heat generating chamber 8 by the viscous fluid stored in the fluid storing chamber 16 in a continuous manner during the rotation of the rotor element 13. Consequently, it is possible to prevent the temperature of the viscous fluid, especially in the radially outer region of the gap, from rising up to a significant level, and to prevent the viscous fluid from being degraded due to an excess temperature rise thereof. Therefore, the heat generator of the first embodiment can maintain good, stable efficiency in heat generation for a long period.

Also, in the first embodiment, the annular communication gap portion 8*a* with a relatively large gap size is defined at the outermost peripheral region of the heat generating chamber 8 to fluidly communicate the front and rear gap portions defined therein with each other. Therefore, especially when the rotor element 13 rotates at relatively high speed, the viscous fluid held in the front and rear gap portions in the heat generating chamber 8 is readily collected in the annular communication gap portion 8*a*. Consequently, the pressure in the communication gap portion 8*a* is increased, and thus the viscous fluid is readily withdrawn through the fluid withdrawing passageway 3*i* to the fluid storing chamber 16. Since the annular communication gap portion 8*a* is provided in the outermost peripheral region of the heat generating chamber 8, the pressure in the communication gap portion 8*a* can be easily increased, the viscous fluid in the communication gap portion 8*a* is subjected to the relatively small fluid friction, and thereby the withdrawal of the viscous fluid from the communication gap portion 8*a* is accelerated. The annular communication gap portion 8*a* also permits the viscous fluid held in both the front and rear gap portions to be withdrawn into the fluid storing chamber 16 which may be provided at least one of the front and rear side of the heat generating chamber 8.

Particularly in the first embodiment, when the rotor element 13 is rotated at any speed, the viscous fluid gathered in the radially inner region of the heat generating chamber 8 is conducted to flow along the channels 2*f* and 3*k* provided on the front and rear inner wall surfaces of the heat generating chamber 8 toward radially outer upper region thereof. More specifically, the viscous fluid held in the front and rear gap portions in the heat generating chamber 8 is readily collected to the top region of the annular communication gap portion 8*a* regardless of the rotation speed of the rotor element 13. Consequently, the pressure in the annular communication gap portion 8*a* is increased, and thus the collected viscous fluid is readily withdrawn through the fluid withdrawing passageway 3*i*, directly opening to the upper front edge of the channel 3*k*, to the fluid storing chamber 16. Further, since the fluid withdrawing passageway 3*i* is formed in the division wall 3*d* of the rear plate member 3, which defines the rear heat receiving chamber 15, the heat of the viscous fluid flowing through the fluid withdrawing passageway 3*i* can be also transmitted to the heat exchanging fluid in the rear heat receiving chamber 15 via the division wall 3*d*.

As previously described, the fluid storing chamber 16 can store the viscous fluid whose volume is larger than the capacity of the fluid holding gap defined in the heat generating chamber 8, and the viscous fluid held in the gap can be constantly replaced and refreshed by the viscous fluid stored in the fluid storing chamber 16, so that the same viscous fluid is not always subjected to the shearing stress within the heat generating chamber 8, and accordingly, the thermal degradation of the viscous fluid, due to continual heat generation, can be suppressed.

Also, since the viscous fluid to be subjected to the shearing action in the heat generating chamber 8 can be surely and easily replaced by the viscous fluid stored in the fluid storing chamber 16 in a continuous manner during the rotation of the rotor element 13, a suitable amount of the fresh viscous fluid can be supplied into the gap in the heat generating chamber 8 so as to allow a sufficient amount of heat to be generated in the heat generating chamber 8. Further, the fluid storing chamber 16 having relatively large volume allows the thermal expansion of the viscous fluid and the gaseous material accommodated in the fluid-tight chamber formed by the heat generating chamber 8 and the fluid storing chamber 16, so as to ensure and maintain a sufficient sealing ability of the sealing mechanism of the bearing 9.

Further, in the viscous fluid type heat generator of the first embodiment, the fluid-tight chamber formed by the heat generating chamber 8 and the fluid storing chamber 16 serves to prevent the viscous fluid such as silicone oil accommodated in both chambers 8, 16 coming into contact with the fresh atmospheric gas, and thus eliminates the addition of water contained in the atmosphere to the viscous fluid. Accordingly, it is possible to solve the problems of the degradation of the viscous fluid due to the contact with fresh atmospheric gas, which generally has arisen in the conventional heat generator including an open-type heat generating chamber.

Figure 6:
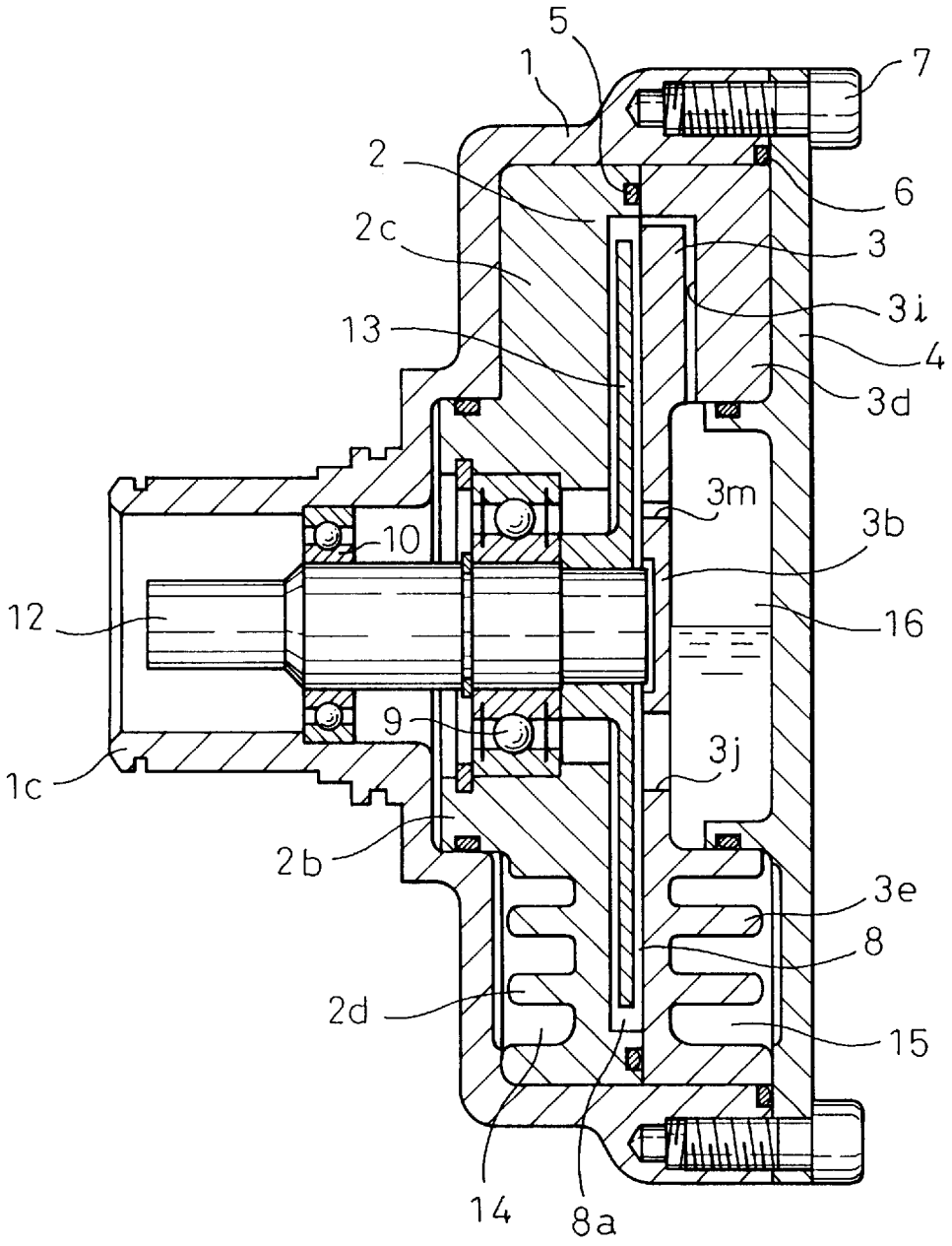
FIG. 6 is a longitudinal sectional view of a second embodiment of a viscous fluid type heat generator according to the present invention, similar to FIG. 1 but with the clutch mechanism shown in FIG. 1 omitted.

FIG. 6 shows a second embodiment of a viscous fluid type heat generator according to the present invention, with an electromagnetic clutch device being not shown in FIG. 6 merely to simplify the drawing. The heat generator of the second embodiment has a structure similar to that of the first embodiment, except for the construction of fluid passageway means for communicating a heat generating chamber with a fluid storing chamber. The other structures are substantially identical to the first embodiment, and are thus designated by the same reference numerals as in the first embodiment and not described in detail again.

The heat generator of the second embodiment includes a rear plate member 3 which is provided with a first fluid withdrawing passageway 3*i* and a second fluid withdrawing passageway 3*m*, both for withdrawing a viscous fluid held in the small gap defined in a heat generating chamber 8 to a fluid storing chamber 16, and a fluid supply passageway 3*j* for supplying a viscous fluid stored in the fluid storing chamber 16 to the heat generating chamber B. The first fluid withdrawing passageway 3*i*, the second fluid withdrawing passageway 3*m* and the fluid supply passageway 3*j* are formed separately from one another in the rear plate member 3.

The first fluid withdrawing passageway 3*i*, similar to the fluid withdrawing passageway 3*i* of the first embodiment, has a bent duct configuration, and penetrates through the rear plate member 3 at the division wall (3*d*) portion thereof to extend in the division wall 3*d* between the front face of the rear plate member 3 and the radially inner, top face of the cylindrical part 3*c* thereof. The first fluid withdrawing passageway 3*i* opens at one end to the top region of an annular communication gap portion 8*a* defined in the heat generating chamber 8, and at the other end to the top region of the fluid storing chamber 16.

The second fluid withdrawing passageway 3*m* has a straight duct configuration, and penetrates through the rear plate member 3 at the center part (3*b*) portion thereof to extend between the front and rear faces of the rear plate member 3. The second fluid withdrawing passageway 3*m* opens at one end to the radially inner, upper region of the heat generating chamber 8, and at the other end to the upper region of the fluid storing chamber 16.

The fluid supply passageway 3*j*, similar to the fluid supply passageway 3*j* of the first embodiment, has a straight duct configuration, and penetrates through the center part 3*b* of the rear plate member 3 to extend between the front and rear faces of the rear plate member 3. The diameter of the fluid supply passageway 3*j* is larger than that of each of the first and second fluid withdrawing passageways 3*i*, 3*m*. The fluid supply passageway 3*j* opens at one end to the radially inner, lower region of the rear gap portion defined in the heat generating chamber 8, and at the other end to the lower region of the fluid storing chamber 16.

In the heat generator of the second embodiment, the amount of the viscous fluid is preferably selected so that, when a drive shaft 12 is positioned in a substantially horizontal state and a rotor element 13 does not rotate, the fluid level of the viscous fluid in the fluid storing chamber 16 is maintained above the fluid supply passageway 3*j* and below the second fluid withdrawing passageway 3*m*.

Also, in the heat generator of the second embodiment, the heat generating chamber 8 includes no channel as a fluid guide, which is provided in the first embodiment in the inner wall surfaces of the heat generating chamber 8 for guiding the viscous fluid held in the front and rear gap portions from the radially inner region of the heat generating chamber 8 toward the outer peripheral region thereof upon rotation of the rotor element 13.

When the viscous fluid type heat generator thus constructed is incorporated into the heating circuit of a vehicle heating system and the engine of a vehicle operates, the output torque of the engine is transmitted through the electromagnetic clutch device (not shown) to the drive shaft 12, and thus to the rotor element 13. When the rotor element 13 is rotated within the heat generating chamber 8, the viscous fluid such as silicone oil is subjected to a shearing stress by the rotating rotor element 13, to generate heat, which is, in turn, transmitted to the heat exchanging fluid flowing through front and rear heat receiving chambers 14 and 15, in the same manner as described in relation to the first embodiment.

In the heat generator of the second embodiment, when the rotor element 13 rotates in the heat generating chamber 8, the fluid pressure in the radially outer region of the heat generating chamber 8 is larger than that in the radially inner region thereof due to the difference of the circumferential speed between the outer peripheral and center regions of the rotor element 13. Therefore, the viscous fluid in the radially outer region is readily withdrawn through the fluid withdrawing passageway 3*i*, opening to the radially outer, higher-pressure, top region of the heat generating chamber 8, into the fluid storing chamber 16. At the same time, the viscous fluid stored in the fluid storing chamber 16 is readily introduced through the fluid supply passageway 3*j*, opening to the radially inner, lower-pressure region of the heat generating chamber 8, into the heat generating chamber 8.

Also, in the second embodiment, an annular communication gap portion 8*a* with a relatively large gap size is defined at the outermost peripheral region of the heat generating chamber 8 to fluidly communicate the front and rear gap portions defined therein with each other. Therefore, especially when the rotor element 13 rotates at relatively high speed, the viscous fluid held in the front and rear gap portions in the heat generating chamber 8 is readily collected in the annular communication gap portion 8*a*. Consequently, the pressure in the communication gap portion 8*a* is increased, and thus the viscous fluid is readily withdrawn through the fluid withdrawing passageway 3*i* to the fluid storing chamber 16, in the same manner as described in relation to the first embodiment.

Particularly in the second embodiment, when the rotor element 13 rotates at relatively low speed, the viscous fluid gathered in the radially inner region of the heat generating chamber 8 due to the stronger Weissenberg effect is readily withdrawn through the second fluid withdrawing passageway 3*m*, directly opening to the radially inner region of the heat generating chamber 8, to the fluid storing chamber 16.

In this manner, the heat generator of the second embodiment permits the viscous fluid held in the small gap defined in the heat generating chamber 8 to smoothly circulate from the outer peripheral and radially inner regions of the gap through the fluid storing chamber 16 to the radially inner region of the gap, irrespective of the rotation speed of the rotor element 13. That is, this heat generator can establish the automatic replacement of the viscous fluid to be subjected to the shearing stress in the heat generating chamber 8 by the viscous fluid stored in the fluid storing chamber 16 in a continuous manner during the rotation of the rotor element 13. Consequently, it is possible to prevent the temperature of the viscous fluid held in the gap from rising to a significant level, and to prevent the viscous fluid from being degraded due to an excess temperature rise thereof. Therefore, the heat generator of the second embodiment also can maintain a good, stable efficiency of heat generation for a long period.

It should be appreciated that the viscous fluid type heat generator of the second embodiment possesses other advantages and characteristic effects, similar to those of the heat generator of the first embodiment.

While the invention has been particularly shown and described with reference to preferred embodiments thereof, it will be understood by those skilled in the art that various changes and modifications may be made without departing from the spirit and scope of the invention. For example, the fluid passageway means may include a plurality of fluid withdrawing passageways formed separately from one another, these fluid withdrawing passageways having separate duct configurations and opening to the heat generating chamber at radially different positions from one another. Also, a fluid guide, such as the channels 2*f*, 3*k* of the first embodiment, may be provided in one of the outer faces of the rotor element, in place of in the inner wall surface of the heat generating chamber. In any event, the scope of the invention is to be determined solely by the appended claims.

We claim:

1. A viscous fluid type heat generator comprising:

a housing assembly defining therein a heat generating chamber in which heat is generated, a fluid storing chamber communicated through fluid passageway means with said heat generating chamber, and a heat receiving chamber arranged separately from said heat generating and fluid storing chambers for permitting a heat exchanging fluid to circulate through said heat receiving chamber to thereby receive heat from said heat generating chamber, said heat generating chamber having inner wall surfaces thereof, in which said fluid passageway means opens, and forming a fluid-tight chamber together with said fluid storing chamber;

a drive shaft supported by said housing assembly to be rotatable about an axis of rotation of the drive shaft, said drive shaft being connected to an external rotation-drive source;

a rotor element mounted to be rotationally driven by said drive shaft for rotation together with the drive shaft within said heat generating chamber, said rotor element having outer faces confronting said inner wall surfaces of said heat generating chamber via a gap defined therebetween; and a viscous fluid, held in said gap defined between said inner wall surfaces of said heat generating chamber and said outer faces of said rotor element, for heat generation by the rotation of said rotor element, and stored in said fluid storing chamber of said housing assembly, said viscous fluid being able to flow between said heat generating chamber and said fluid storing chamber through said fluid passageway means;

wherein said fluid passageway means comprises a fluid withdrawing passageway for withdrawing said viscous fluid from said gap in said heat generating chamber into said fluid storing chamber and a fluid supply passageway for supplying said viscous fluid from said fluid storing chamber into said gap in said heat generating chamber;

said fluid withdrawing passageway having a separate duct configuration and opening at one end to an outer peripheral region of said heat generating chamber to communicate said outer peripheral region of said heat generating chamber with said fluid storing chamber; and said fluid supply passageway having a separate duct configuration and opening at one end to a radially inner region of said heat generating chamber to communicate said radially inner region of said heat generating chamber with said fluid storing chamber.

2. The viscous fluid type heat generator of claim 1, wherein said fluid withdrawing passageway opens to said fluid storing chamber at a position above a fluid level of said viscous fluid accommodated in said fluid storing chamber, and wherein said fluid supply passageway opens to said fluid storing chamber at a position below said fluid level of said viscous fluid accommodated in said fluid storing chamber.

3. The viscous fluid type heat generator of claim 1, wherein said fluid passageway means further includes a second fluid withdrawing passageway opening to a radially inner region of said heat generating chamber, said second fluid withdrawing passageway being formed separately from first said fluid withdrawing passageway and said fluid supply passageway, to communicate said radially inner region of said heat generating chamber with said fluid storing chamber.

4. The viscous fluid type heat generator of claim 3, wherein said first and second fluid withdrawing passageways open to said fluid storing chamber at positions above a fluid level of said viscous fluid accommodated in said fluid storing chamber, and wherein said fluid supply passageway opens to said fluid storing chamber at a position below said fluid level of said viscous fluid accommodated in said fluid storing chamber.

5. The viscous fluid type heat generator of claim 1, wherein said heat generating chamber defines in said outer peripheral region thereof an annular communication gap portion between a circumferential wall surface of said heat generating chamber and a circumferential face of said rotor element to join opposed gap portions disposed at front and rear sides of said rotor element, and wherein said fluid withdrawing passageway opens to and confronts said annular communication gap portion.

6. The viscous fluid type heat generator of claim 1, further includes a fluid guide provided in said heat generating chamber for guiding said viscous fluid held in said gap along said fluid guide from said radially inner region of said heat generating chamber toward said outer peripheral region thereof upon rotation of said rotor element.

7. The viscous fluid type heat generator of claim 6, wherein said fluid guide includes at least one channel recessed in at least one of inner wall surfaces of said heat generating chamber to open, over substantially an entire length of said channel, to said heat generating chamber, said channel extending from said radially inner region of said heat generating chamber toward said outer peripheral region thereof.

8. The viscous fluid type heat generator of claim 7, wherein said at least one channel linearly extends along a center line thereof which is angularly shifted from a radial line of said at least one of inner wall surfaces so that a radially inner end of said channel is displaced rearward relative to said radial line in a direction of rotation of said rotor element.

9. The viscous fluid type heat generator of claim 8, wherein said withdrawing passageway opens at one end to and directly communicates with said channel.

10. The viscous fluid type heat generator of claim 1, further includes a partition member for separating said heat generating chamber from said fluid storing chamber, said fluid withdrawing passageway being formed in said partition member.

11. The viscous fluid type heat generator of claim 10, wherein said partition member is provided with a division wall for defining a passage of said heat exchanging fluid in said heat receiving chamber, said fluid withdrawing passageway being formed in said division wall.

12. The viscous fluid type heat generator of claim 1, wherein said fluid storing chamber is designed to accommodate said viscous fluid, an amount of which is larger than the capacity of said gap defined in said heat generating chamber, and wherein said fluid storing chamber is formed adjacent to said heat receiving chamber.

* * * * *